US006234369B1

(12) United States Patent
Bort

(10) Patent No.: US 6,234,369 B1
(45) Date of Patent: May 22, 2001

(54) DEVICE FOR PUTTING ON HOSIERY AND DRIVE UNIT THEREFOR

(75) Inventor: Rudi Bort, Weinstadt (DE)

(73) Assignee: Bort GmbH, Weinstadt (DE)

( * ) Notice: Subject to any disclaimer, the term of this patent is extended or adjusted under 35 U.S.C. 154(b) by 0 days.

(21) Appl. No.: 09/601,244

(22) PCT Filed: Jan. 29, 1999

(86) PCT No.: PCT/EP99/00577

§ 371 Date: Sep. 14, 2000

§ 102(e) Date: Sep. 14, 2000

(87) PCT Pub. No.: WO99/38424

PCT Pub. Date: Aug. 5, 1999

(30) Foreign Application Priority Data

Jan. 30, 1998 (DE) ..... 198 03 503

(51) Int. Cl.[7] ..... A47G 25/90
(52) U.S. Cl. ..... 223/112; 223/111
(58) Field of Search ..... 223/111, 112, 223/120, 116; 33/2 A, 3 A, 3 B, 3 C

(56) References Cited

U.S. PATENT DOCUMENTS 1,876,344 * 9/1932 Pucunas ..... 223/75
2,601,131 * 6/1952 Weber ..... 333/3 A
2,982,453 * 5/1961 Zicarelli ..... 223/111
5,593,071 1/1997 Lusk .
6,019,259 * 2/2000 Stanecki ..... 223/80

FOREIGN PATENT DOCUMENTS 39 14 824 11/1990 (DE) .
0 764 419 3/1997 (EP) .

* cited by examiner

*Primary Examiner*—Bibhu Mohanty
(74) *Attorney, Agent, or Firm*—Evenson, McKeown, Edwards & Lenahan, P.L.L.C.

(57) ABSTRACT

The invention relates to a device for putting on hosiery, comprising a unit for mounting the hosiery which has two receiving parts which by way of guiding means can be spread in relation to each other between a resting position and at least one stretching position. In said device the positioning means form part of a drive unit embodied as an element which is separate from the mounting unit and said mounting unit can be temporarily and removably connected to the drive unit with a view to moving the receiving parts into the at least one stretching position. The invention also relates to the use of said device for putting on support hose.

16 Claims, 9 Drawing Sheets

DEVICE FOR PUTTING ON HOSIERY AND DRIVE UNIT THEREFOR

BACKGROUND AND SUMMARY OF THE INVENTION

The invention relates to a device for putting on hosiery with a put-on unit for the hosiery that has two receiving parts spreadable with respect to one another between a resting position and at least one tensioning position by guide means.

Such a device for putting on hosiery is known from DE 42 28 916 C2. Such a device is provided as a put-on aid for compression stockings whose fit for the individual user poses problems for the user regardless of whether these compression stockings have open or closed toes. The put-on aid is formed by a put-on unit made of two half-shell-shaped receiving parts adjustable with respect to one another in the vicinity of their semicircular toes with the aid of adjusting devices that are movable lengthwise with respect to one another between these foot ends. Adjustment is performed manually by twisting adjusting nuts or bayonet elements. To put on such a compression stocking, the put-on unit is placed on a surface and the corresponding compression stocking is turned to the left and put onto the receiving parts opposite one another in the shape of half-shells. Then the receiving parts are spread apart by the adjusting devices, tensioning the compression stocking to the point where the user can insert his foot into the foot section of the compression stocking between the two receiving parts. After the foot section has been applied in this manner, the rest of the area of the compression stocking can be put off the receiving parts and rolled upward or put up on the leg.

The goal of the invention is to provide a device of the species recited at the outset which allows further simplified, more comfortable putting on of hosiery by comparison with the prior art.

This goal is achieved for a device of the species recited at the outset with adjusting means for moving the receiving parts relative to one another into the desired position so that the adjusting means are part of a drive unit made as a part separate from the put-on unit. The put-on unit is temporarily releasably connectable with the drive unit to adjust the receiving parts into the at least one tensioned position of the receiving parts. By means of the drive unit, it is possible to tension the put-on unit with hosiery put on quickly and simply without manual application of force. The separability between the put-on unit and the drive unit permits simple operation and a location-independent function of the put-on unit. Thus, a drive unit for tightening several put-on units can be provided in particular.

The goal is also achieved for a device of the type recited at the outset provided with locking means to secure the receiving parts relative to one another in the adjusted position by virtue of the fact that the put-on unit is provided with a foot arrangement by means of which the put-on unit can be placed on a foundation and assume a diagonal position that is ergonomically favorable for the insertion of a foot to be covered by hosiery. As a result, getting into the foot section of a compression stocking or another type of hosiery is considerably simplified for the user, and offers advantages especially for persons with reduced mobility.

In one embodiment of the invention, the guide means have a manually releasable locking device which is positively operable in at least one tensioning position. Latching devices are provided in particular as the locking arrangement, whose latching elements are associated with the corresponding guide means of the receiving parts.

Support or compression stockings with or without a foot section, with a closed or open toe, or even pantyhose or other types of stockings are provided as the hosiery.

In another embodiment of the invention, the guide means are provided as a linear guide with guide profiles on both receiving parts that are slidable into one another telescopically. This is an especially simple and secure design that guarantees lengthwise displaceability of the receiving parts with respect to one another.

In another embodiment of the invention, each receiving part is composed of a guide body that has the guide profile and a funnel part provided for putting on the hosiery. Each receiving part thus forms half of a funnel, with the two funnel halves not having to be made identical to one another. Preferably, the funnel parts are made of bent steel wire. However, they can also be made as half shells. The guide bodies, which are preferably provided in the lower part of the receiving part, are preferably made of plastic and are provided with the guide profiles. If the guide bodies are made of plastic and the funnel parts have a wire structure, their guide bodies have receiving profiles to securely hold and fasten the funnel parts.

In another embodiment of the invention, the drive unit has a linear drive. This drive is in an effective connection with the receiving parts of the put-on unit. Such a linear drive can be made electrical in particular but can also be pneumatic or hydraulic.

In another embodiment of the invention, the linear drive has a supporting piston located endwise which is supported on a corresponding supporting part of the put-on unit. Preferably, the supporting part of the put-on unit is provided in the vicinity of the foot arrangement of the put-on unit so that the foot arrangement can assume a double function. Advantageously, one of the two receiving parts on the drive unit is held stationary while the other is moved by the supporting piston.

Additional advantages and features of the invention follow from the claims as well as a description below of a preferred embodiment of the invention shown in the drawings.

DETAILED DESCRIPTION OF THE DRAWINGS

Figure 1:
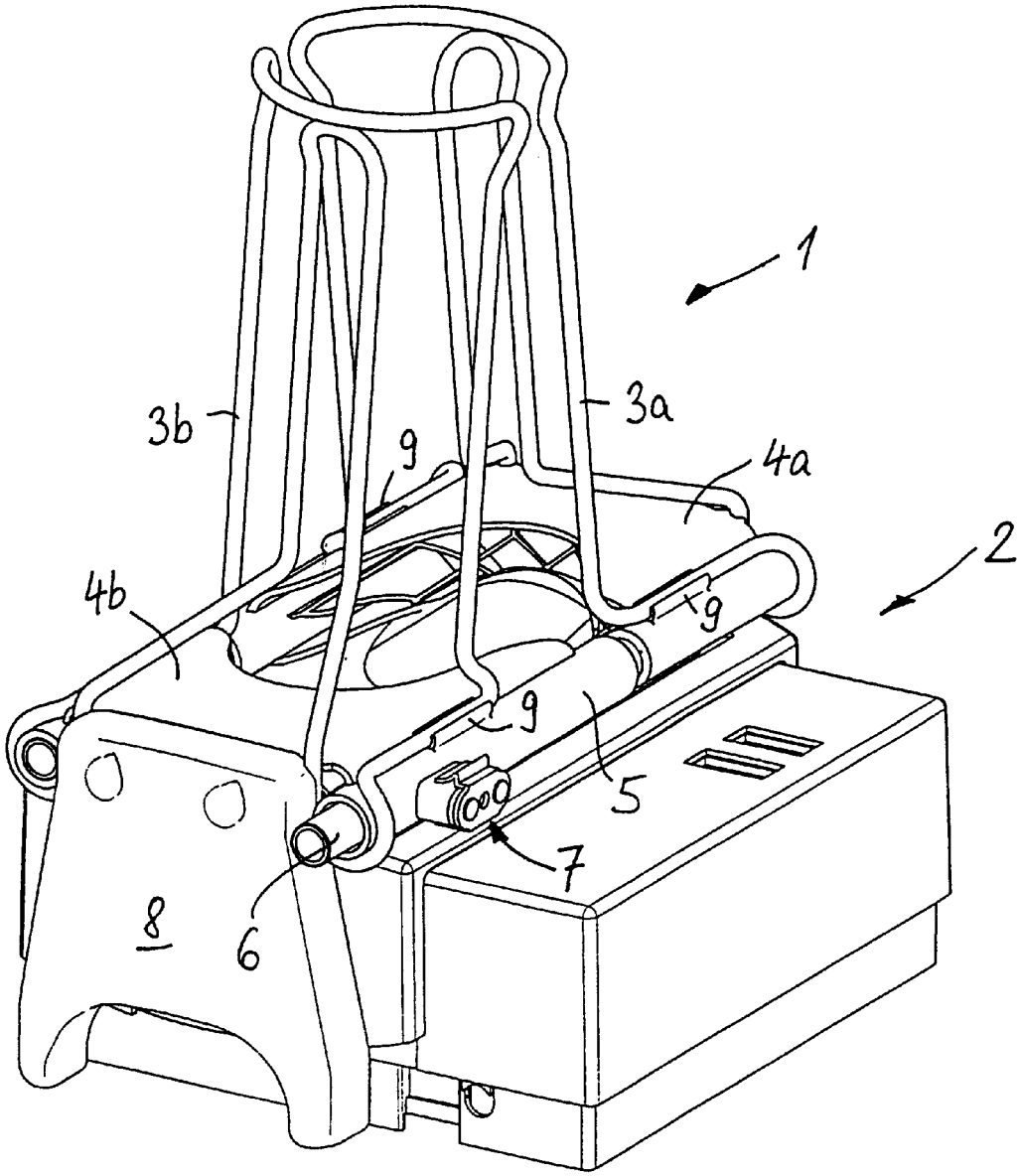
FIG. 1 shows an embodiment of a put-on device according to the invention including a put-on unit and a drive unit in a resting position.
Figure 2:
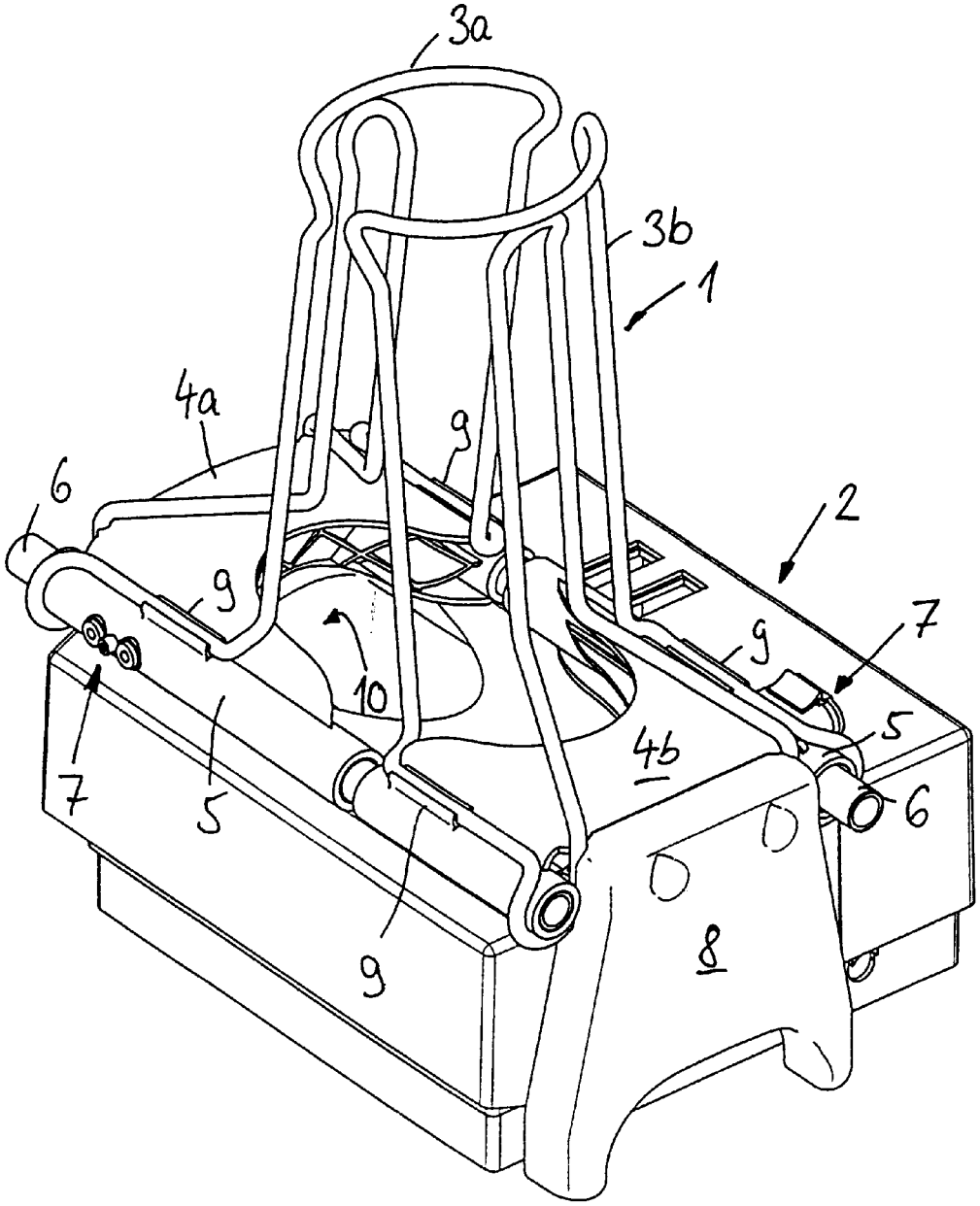
FIG. 2 shows the put-on device according to FIG. 1 from a different perspective.
Figure 3:
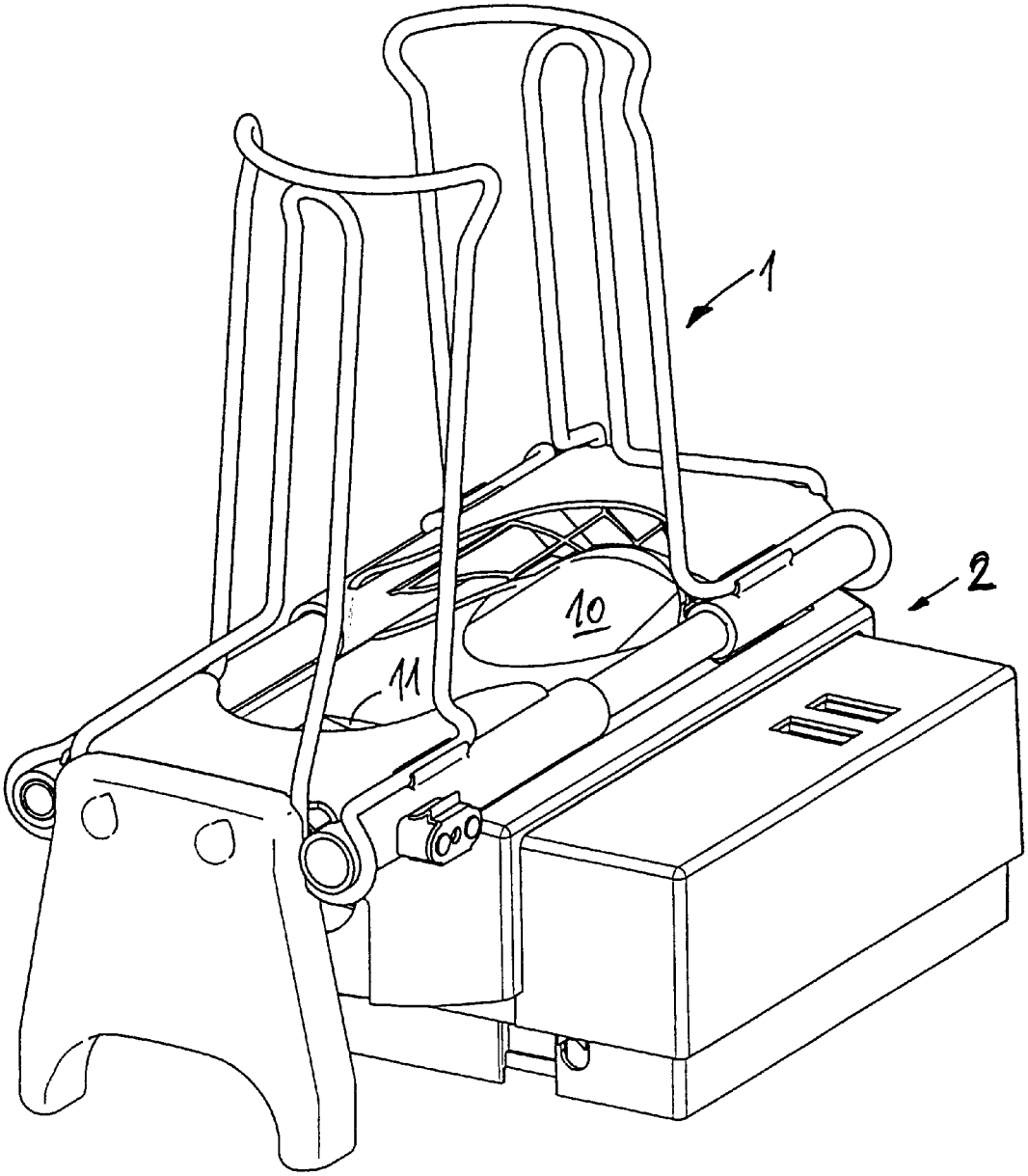
FIG. 3 shows the put-on device according to FIGS. 1 and 2 in a tensioned position.
Figure 4:
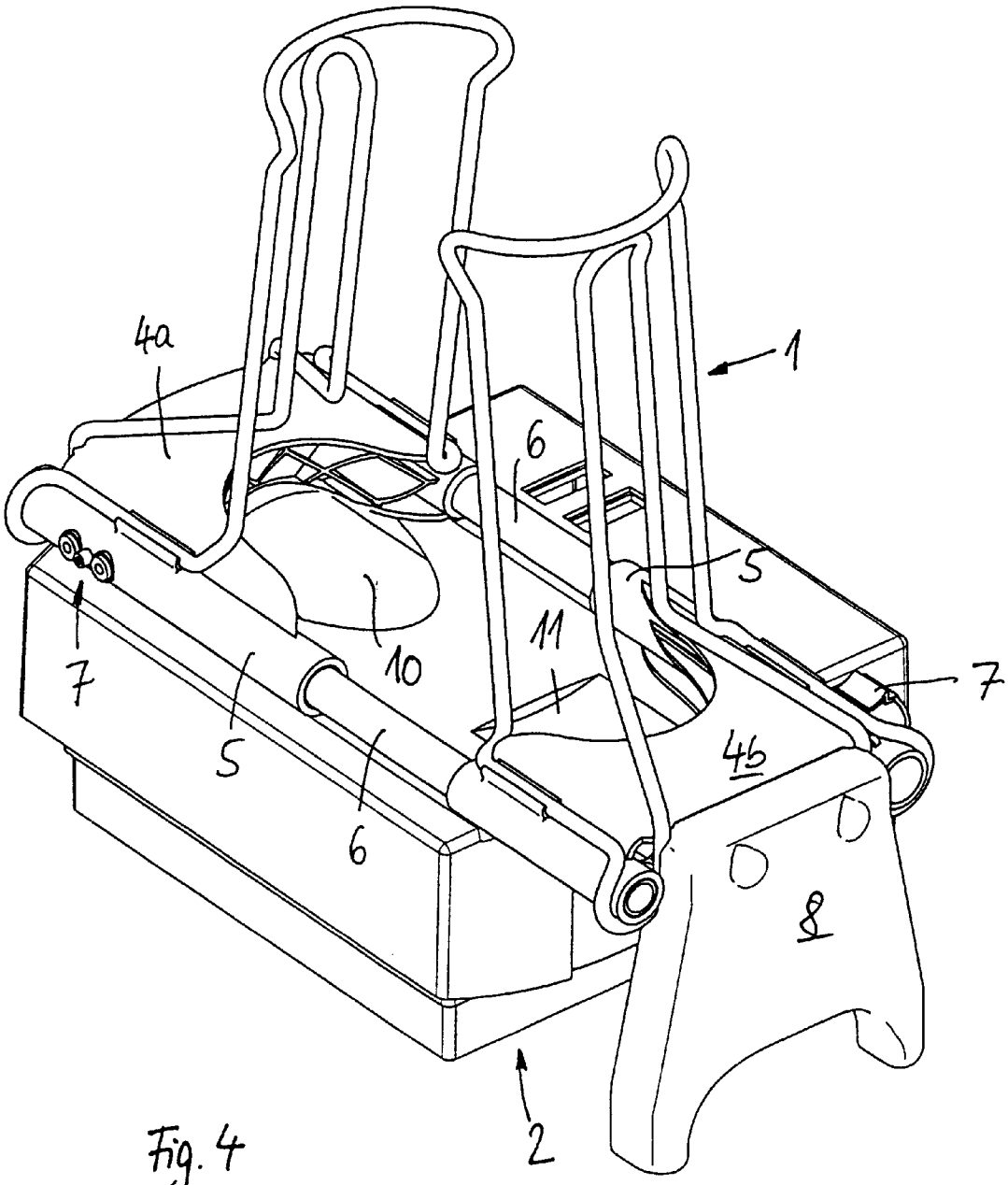
FIG. 4 shows the put-on device according to FIGS. 1 to 3 in the tensioned position according to FIG. 3 but in another perspective view.

A device referred to below as a put-on aid for putting on hosiery, especially compression stockings, has a put-on unit 1 as well as a box-shaped drive unit 2. The put-on unit 1 can be mounted on the drive unit 2 in a manner described in greater detail below in order to be transferred to a clamping position.

Put-on unit 1 is formed by two upwardly-projecting funnel parts 3*a*, 3*b* which are each made in the shape of half of a funnel and are associated with one another so that they can be combined into a funnel shape. Both funnel parts 3*a*, 3*b* have a stable steel wire construction, with each funnel part 3*a*, 3*b* having a semicircular curvature in an upper area which merges with struts that extend diagonally downward and outward. The support for the semicircular insertion area of each funnel part 3*a*, 3*b* is provided by a U-shaped curved double strut which continues downward. Each funnel part 3*a*, 3*b* is connected positively in its lower area with a guide body 4*a*, 4*b* made of plastic. Each guide body 4*a*, 4*b* is provided on its opposite outer sides with integrated guide profiles 5, 6. The opposite guide bodies 4*a*, 4*b* have guide profiles 5, 6 corresponding alternately to one another such that they can be inserted into one another telescopically. As a result, lengthwise displaceability of the two receiving parts 3*a*, 4*a*; 3*b*, 4*b* of put-on unit 1 is created. As can be seen in FIGS. 1 to 4 as well as 8 to 12, put-on unit 1 is associated on one side with a foot arrangement in the form of a supporting foot 8 that is permanently connected with guide body 4*b* of one receiving part and projects downward at right angles to guide body 4*b*. When put-on unit 1 is set up on a plane base, put-on unit 1 is in a diagonal position whose angle is arranged so that an ergonomically especially favorable entry of a user from above is made possible.

Funnel parts 3*a*, 3*b* are positively latched by corresponding strut sections in the vicinity of the guide profiles of the respective guide bodies 4*a*, 4*b* between upwardly projecting rib portions 9. In addition, circular strut sections are guided positively around the undersides of the guide profiles of guide bodies 4*a*, 4*b*.

As will be described in greater detail below, put-on unit 1 is placed with the underside of the two guide bodies 4*a*, 4*b* on the housing of drive unit 2 in such fashion that a receiving part 3*a*, 4*a* or 3*b*, 4*b* is held stationary on the housing and the other receiving part 3*b*, 4*b* or 3*a*, 4*a* is displaced lengthwise by drive unit 2 correspondingly relative to the other receiving part. In order to ensure secure positioning of put-on unit 1 on drive unit 2, guide ribs 30 are provided firstly on the underside of guide bodies 4*a*, 4*b* in the vicinity of the external guide profiles, said ribs being aligned in the lengthwise direction of put-on unit 1. In addition, centrally on the underside of each guide body 4*a*, 4*b*, there is a centering arrangement 29 in the form of a spherical projection. Each spherical projection 29 has a stop surface on an inner face turned toward the other guide body 4*a*, 4*b* that is provided with a circular recess 24 to receive a holding pin 17 of drive unit 2 that serves as a support and centering profile.

Figure 5:
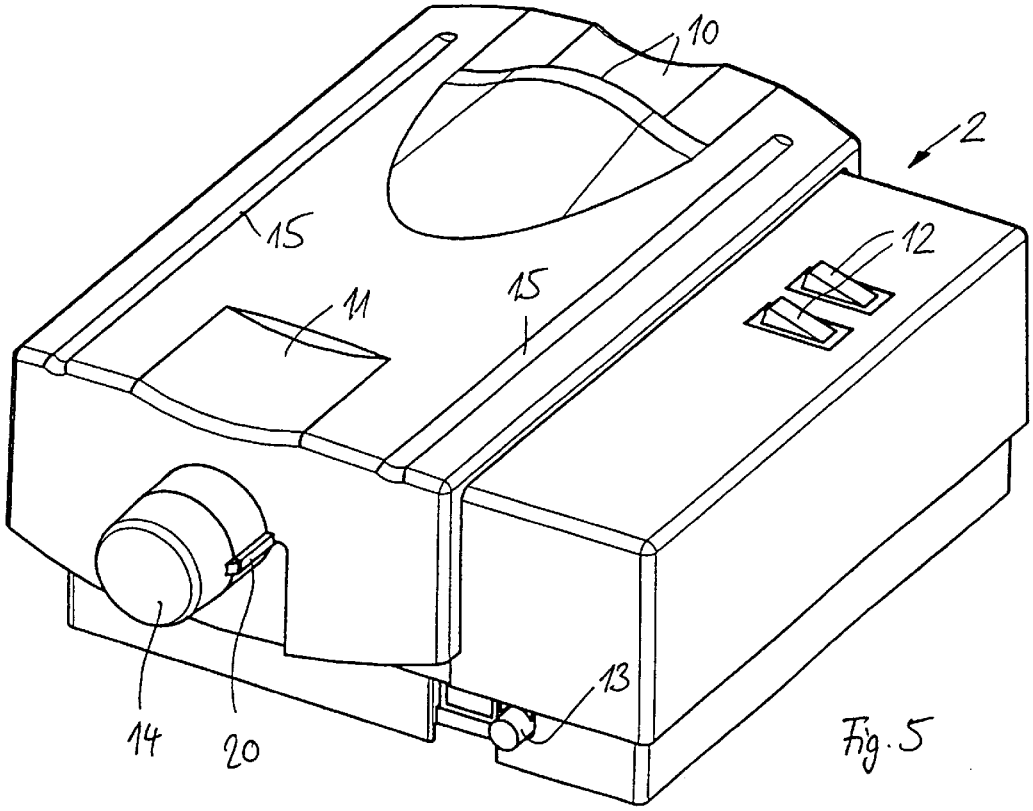
FIG. 5 is a perspective view of the box-shaped drive unit of the put-on device according to FIGS. 1 to 4.
Figure 6:
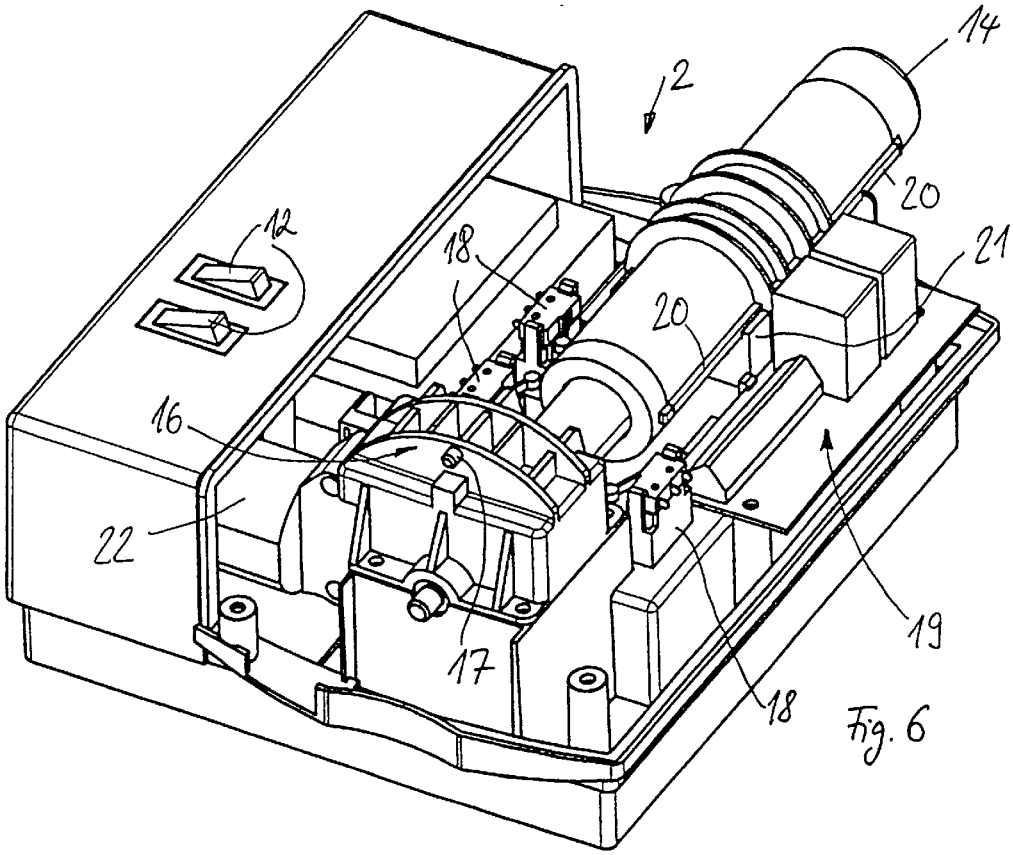
FIG. 6 shows the drive unit according to FIG. 5 but in a perspective rotated through 180° and without a housing top.
Figure 7:
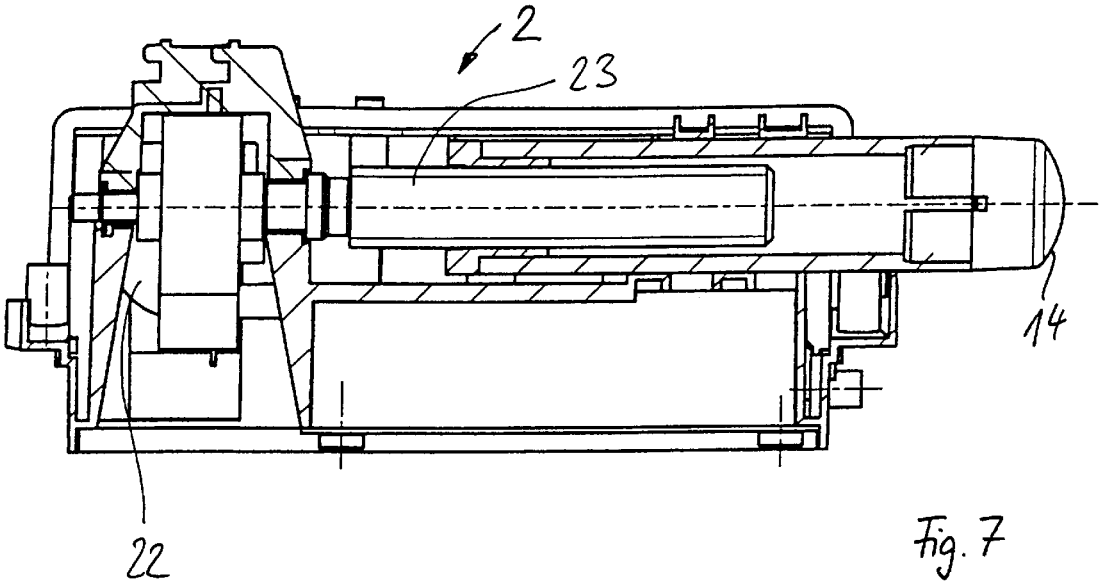
FIG. 7 shows the drive unit according to FIGS. 5 and 6 in a lengthwise section.

Drive unit 2 according to FIGS. 5 to 7 has a housing that can be removed and allows access to the inside of the housing and thus to the drive functional elements. The housing is in the form of a box and on its top side (FIG. 5) has on one side as a centering means, i.e. as a centering profile, an indentation 11 and on the other side a corresponding indentation 10 that serves as a centering and supporting profile, which is also provided with a dome-like projection that functions as a supporting profile. The shoulder of indentation 10, which is in the shape of a dome and therefore curved convexly, is supported by a supporting rib structure 16 from the interior of the housing which is connected in stable fashion with the housing bottom which also supports the functional elements of the drive. The supporting rib structure 16 serves to support the end provided with holding pin 17 in order to avoid damage when stronger forces are applied from the front because of the mounted put-on unit 1. One end of the supporting rib structure 16 is provided with the holding pin 17 already described, which projects endwise from the shoulder of centering means 10. Holding pin 17 engages the matching receptacle 24 of the end stop surface on the underside of the respective guide body 4*a*, 4*b*. As a result, an axial stop is provided for the respective guide body of put-on unit 1. In addition, the top of the housing has guide grooves 15 running lengthwise that serve as guide profiles into which guide ribs 30 on the undersides of guide bodies 4*a*, 4*b* of put-on unit 1 can be engaged.

The inside of supporting foot 8 of put-on unit 1 that faces drive unit 2 is provided in its function as a supporting part with a centrally located centering receptacle 28 into which a matching end 14 of an adjusting piston of drive unit 2 engages. The adjusting piston by its function forms an adjusting nut on a spindle drive that rests on a rotationally movably mounted threaded spindle 23 (FIG. 7). This spindle drive is part of the linear drive of the put-on device. Threaded spindle 23 is driven through a transmission unit, not shown in greater detail, by an electric motor 22 which is likewise integrated into the housing of drive unit 2. In order to prevent rotation of the adjusting piston, the latter is provided with lateral guide ribs 20 which have matching supporting guides 21 on the housing. The lateral guide ribs 20 are provided at certain locations with recesses which serve to actuate limit switches 18 that actuate the linear drive. The limit switches 18 are provided for the resting position of put-on unit 1 and also for two different tensioning positions of put-on unit 1. Limit switch 18 for switching the electric motor 22 of the linear drive is designed so that the adjusting piston including its end 14, after reaching the clamping position and following the latching of the locking device 17 of the put-on unit 1, to be described below, is moved backward a certain amount again toward the resting position in order to free the put-on unit 1 so that it can be lifted off upward. To control electric motor 22, an electronic control unit 19 is provided which has various electronic elements mounted on a PC board. In addition to an on/off switch 13 (FIG. 5) for the power supply, two switches 12 are also provided, one of which specifies the clamping position and the other turns on the electric motor.

Figure 10:
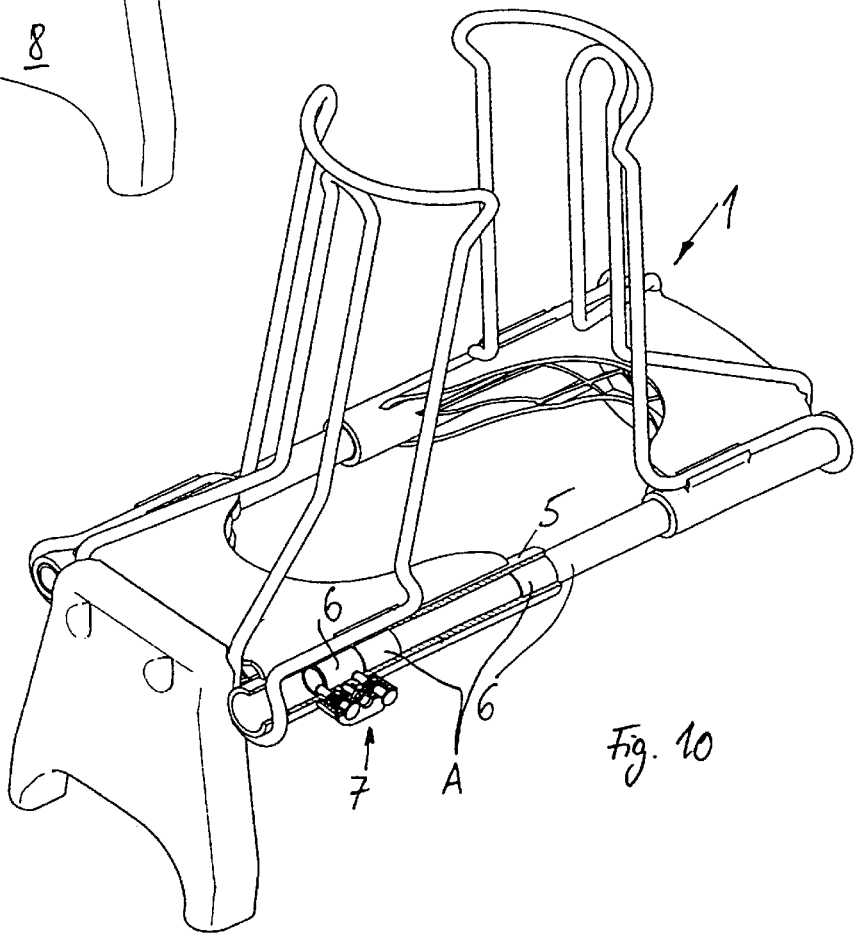
FIG. 10 shows the put-on unit according to FIG. 9 in a partially sectioned view.
Figure 11:
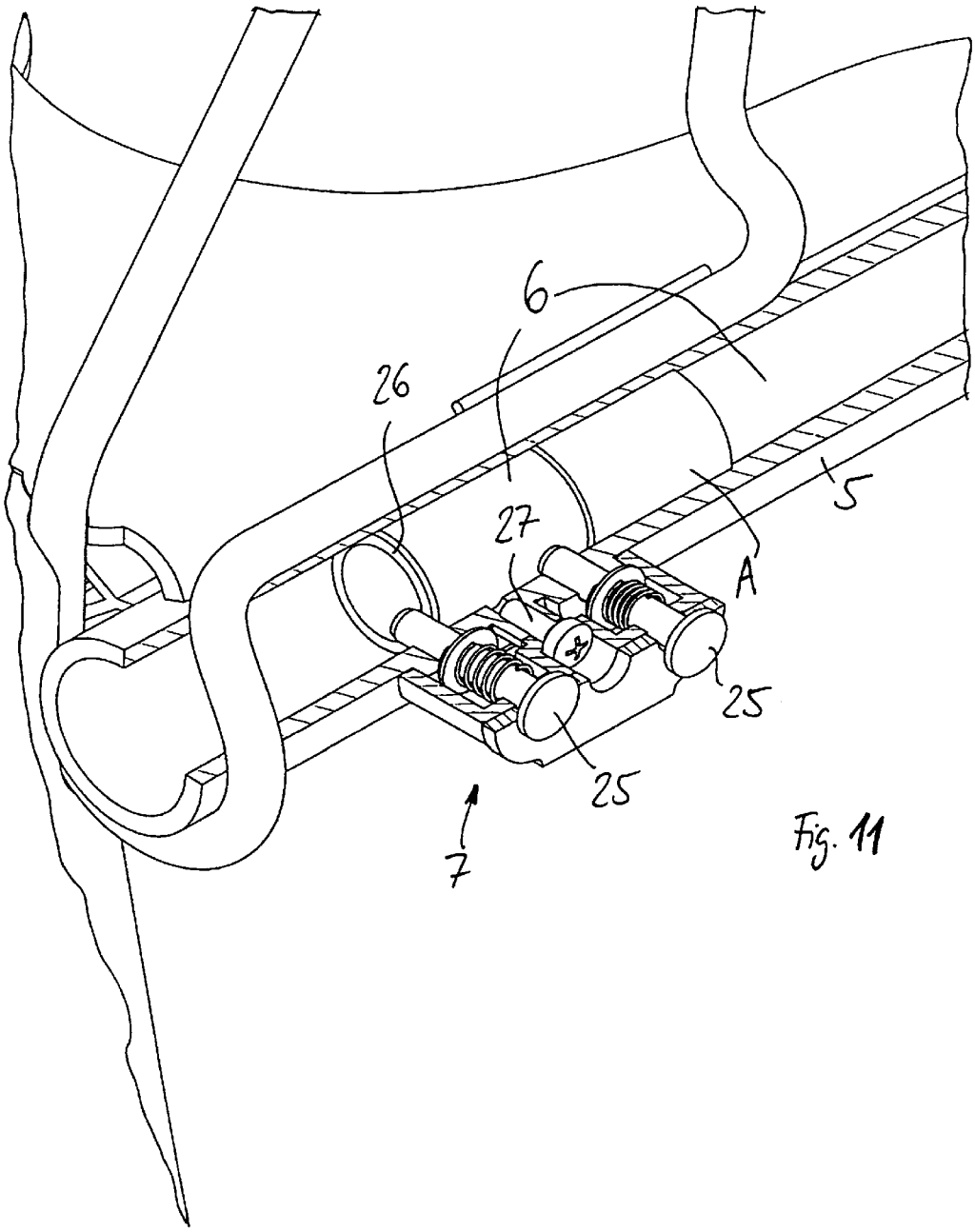
FIG. 11 shows a portion of the put-on unit according to FIG. 10 in an enlarged view.
Figure 12:
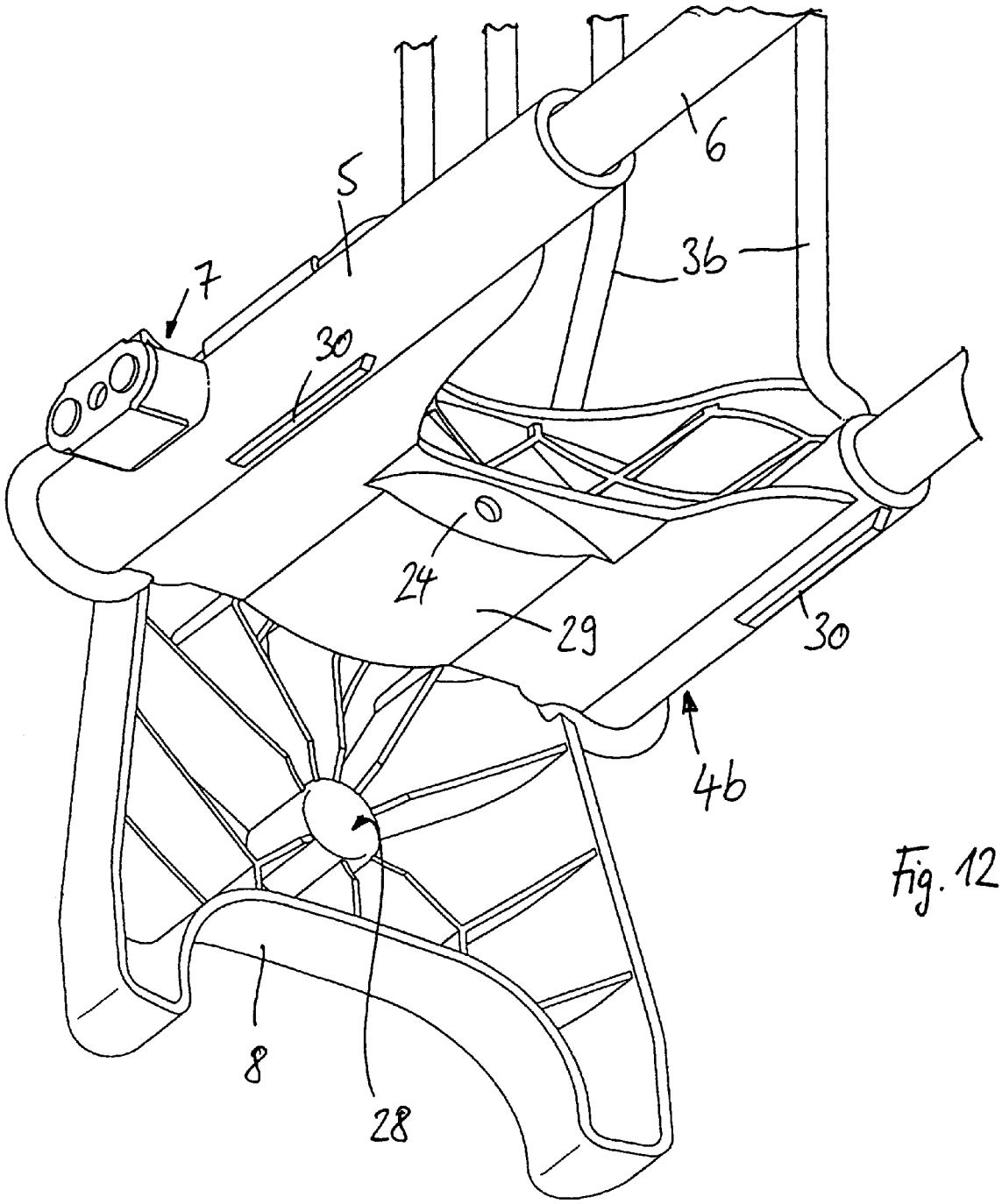
FIG. 12 shows a portion of the put-on unit in FIGS. 8 to 10 in a perspective view from below.

Put-on unit 1 has two locking devices 7 arranged on each side with respect to a guide profile arrangement 5, 6. The inner tubular guide profile 6 on each guide body 4*a*, 4*b* is rigidly jacketed by the corresponding plastic part while the jacket in the vicinity of locking device 7 of the other guide body 4*a*, 4*b* with formation of the outer guide profile 5 allows slidably movable displacement of the inner guide profile 6 by one or more bearing bushings A made of slidable material. Locking devices 7 are positioned so that they are located in the two clamping positions at the level of the respective end 26 (FIGS. 10 and 11) of each internal guide profile (6). Locking device 7 in the embodiment shown has two latching pins 25 that are urged inward by springs.

Latching pins 25 are secured in a housing part radially to the lengthwise axis of the guide profile 6 at the outer guide profiles 5 of the respective guide body 4*a*, 4*b* with the aid of a retaining screw 27. To release the latching pins 25, an actuating slide not described in greater detail is provided, allowing the latch to be released manually.

Figure 8:
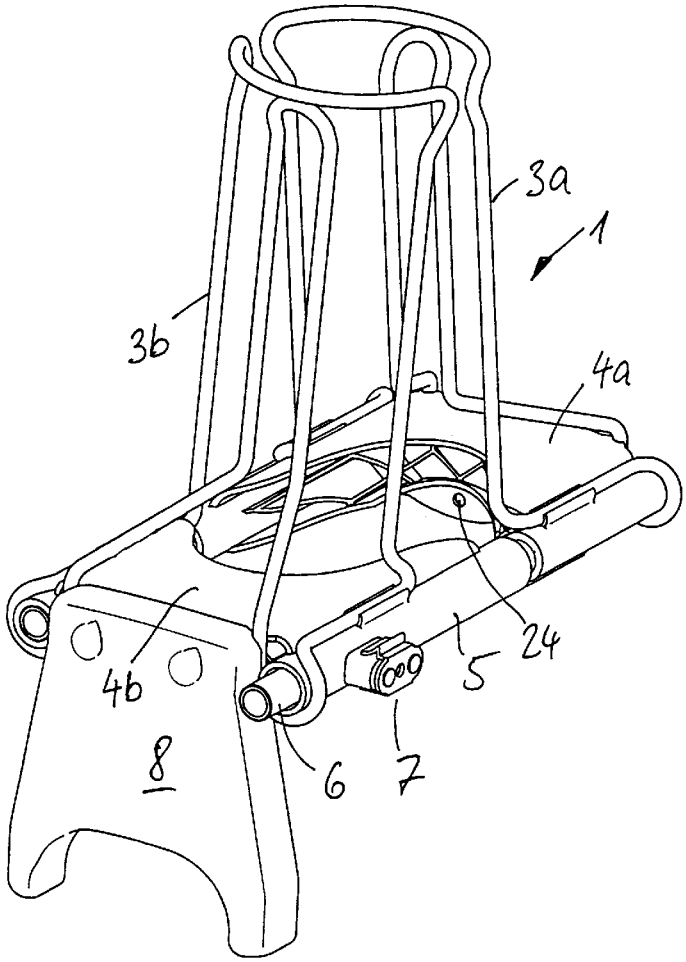
FIG. 8 shows the put-on unit of the put-on device according to FIGS. 1 to 4 in its diagonal functional position.
Figure 9:
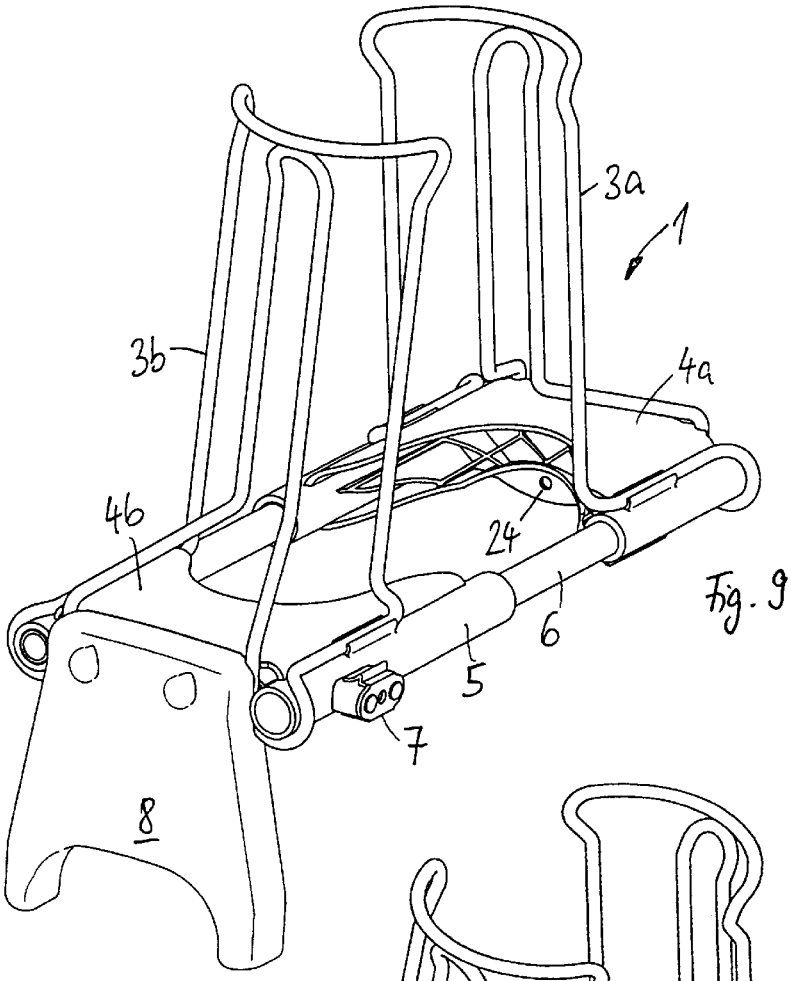
FIG. 9 shows the put-on unit according to FIG. 8 in its tensioned state.

To put on a compression stocking, the compression stocking is first placed on a put-on unit 1 in its resting position separately from the drive unit according to FIG. 8 or in its position shown in FIG. 1 on drive unit 2, turned to the left and gathered until the toe area, and especially the tip of the stocking, is positioned in the vicinity of the upper semicircular area of each funnel part. Now, put-on unit 1, if it is not already on the drive unit, is placed on the housing of drive unit 2 so that the centering guide and support means 10, 11, 15; 30, 24, 29, 17 engage one another and the end 14 of the adjusting piston is positioned at the level of centering recess 28 of supporting foot 8. Now, the linear drive is set in motion so that the adjusting piston with its end 14 pushes supporting foot 8 and thus the corresponding guide body 4*b* against the elastic tension of the put-on compression stocking with expansion and spreading of the compression stocking depending on a desired position until the first or second tensioned position is reached. When the respective tensioned position is reached, the respective spring pin 25 of locking arrangement 7 latches behind the end 26 of guide profile 6 of the receiving part 3*a*, 4*a* held stationary. This preferably takes place on both sides so that both locking arrangements 7 assume a corresponding latching position behind the ends 26 of guide profiles 6. As a result of the elastic tensioning of the compression stocking, put-on unit 1 is held securely in this position. Then the put-on unit 1 is advantageously removed from drive unit 2 and placed on the plane surface, assuming its diagonal position shown in FIGS. 9 and 10. The user can then insert his foot into the expanded opening between the semicircular areas of funnel parts 3*a*, 3*b* and thus into the toe of the compression stocking and push his foot downward so that the gathered compression stocking necessarily fits on the foot over a portion of the lower leg. By putting off the remaining part of the compression stocking from the two funnel parts 3*a*, 3*b* upward, the compression stocking can then be put on completely.

What is claimed is:

1. Device for putting on hosiery with a put-on unit for the hosiery that has two receiving parts that are spreadably movable relative to one another between a resting position and at least one tensioned position by guide means, as well as with positioning means for moving the receiving parts relative to one another into the desired position, wherein an adjusting means forms part of a drive unit, designed as a part separate from the put-on unit, and wherein the put-on unit is temporarily releasably connectable with the drive unit for adjusting the receiving parts into at least one tensioned position.

2. Device for putting on hosiery with a put-on unit for the hosiery that has receiving parts that are spreadably movable relative to one another between a resting position and at least one tensioned position by guide means, said receiving parts being provided with locking means to hold the receiving parts relative to one another in the adjusted position, wherein the put-on unit is provided with a foot arrangement, by which the put-on unit can be placed in a diagonal position on a base to allow a to be stockinged foot to be inserted.

3. Drive unit for a device for putting on hosiery according to claim 1, wherein the drive unit has supporting means for temporarily holding the put-on unit and for supporting a receiving part that is stationary relative to the movable receiving part.

4. Device according to claim 1, wherein the guide means have a manually releasable locking system which operates positively in at least one tensioning position.

5. Device according to claim 4, wherein the guide means are designed as a linear guide with guide profiles on both receiving parts that can be slid into one another telescopically.

6. Device according to claim 5, wherein each receiving part is composed of a guide body that has guide profiles and a funnel part provided for putting on the hosiery.

7. Device according to claim 1, wherein the drive unit has a linear drive which is in an effective connection with the receiving parts of the put-on unit.

8. Device according to claim 7, wherein a spindle drive is provided as a linear drive that is drivable by an electric motor.

9. Device according to claim 7, wherein the linear drive has a support piston located endwise that is supported on a matching supporting part of the put-on unit.

10. Device according to claim 1, wherein the drive unit has a housing provided with supporting, centering, and/or guide profiles and wherein the guide bodies of the put-on unit have suitably adjusted profiles.

11. Drive unit according to claim 3, wherein the drive unit has a linear drive which is in an effective connection with the receiving parts of the put-on unit.

12. Drive unit according to claim 11, wherein a spindle drive is provided as a linear drive that is drivable by an electric motor.

13. Drive unit according to claim 11, wherein the linear drive has a support piston located endwise that is supported on a matching supporting part of the put-on unit.

14. Drive unit according to claim 3, wherein the drive unit has a housing provided with supporting, centering, and/or guide profiles and wherein the guide bodies of the put-on unit have suitably adjusted profiles.

15. A device for putting on hosiery, comprising:

a put-on unit for hosiery having two receiving parts spreadably movable relative to one another between a resting position and at least one tensioned position, and an adjuster operable to move the receiving parts relative to one another into a desired position;

a drive unit separate from said put-on unit, said adjuster being part of said drive unit; and wherein said put-on unit is temporarily releasably connectable with said drive unit to adjust the receiving parts into the at least one tensioned position.

16. A device for putting on hosiery, comprising:

a put-on unit for hoisery having receiving parts spreadably movable relative to one another between a resting position and at least one tensioned position;

a lock operable to hold the receiving parts relative to one another in an adjusted position;

a foot stand provided for said put-on unit, by which said put-on unit is placeable in a diagonal position on a base of said foot stand to allow a to be stocking foot to be inserted.

* * * * *